United States Patent [19]

Ramachandran

[11] Patent Number: 4,933,100

[45] Date of Patent: Jun. 12, 1990

[54] BUILT SYNTHETIC ORGANIC DETERGENT COMPOSITION PATTIES AND PROCESSES FOR WASHING LAUNDRY THEREWITH

[75] Inventor: Pallassana N. Ramachandran, Robbinsville, N.J.

[73] Assignee: Colgate-Palmolive Co., Piscataway, N.J.

[21] Appl. No.: 145,427

[22] Filed: Jan. 19, 1988

[51] Int. Cl.[5] ..... C11D 1/62; C11D 3/395; C11D 17/00

[52] U.S. Cl. ..... 252/95; 252/90; 252/174; 252/528; 252/547; 252/539; 252/558; 252/DIG. 16

[58] Field of Search ..... 252/90, 134, 174, DIG. 16, 252/539, 528, 95

[56] References Cited

U.S. PATENT DOCUMENTS

| | | | |
|---|---|---|---|
| 1,764,866 | 6/1930 | Charlton | 252/134 |
| 2,875,155 | 2/1959 | Miles | 252/134 |
| 3,081,267 | 3/1963 | Laskey | 252/135 |
| 3,726,813 | 4/1973 | Borello | 252/539 |
| 3,746,647 | 7/1973 | Peloquin | 252/174 |
| 3,824,189 | 7/1974 | Borello | 252/99 |
| 4,326,971 | 4/1982 | Wixon | 252/8.75 |
| 4,370,250 | 1/1983 | Joshi | 252/174 |
| 4,399,049 | 8/1983 | Gray et al. | 252/91 |
| 4,450,085 | 5/1984 | Wixon | 252/8.75 |
| 4,524,012 | 6/1985 | Wixon | 252/175 |
| 4,543,204 | 9/1985 | Gervasio | 252/529 |
| 4,707,289 | 11/1987 | Ramachandran et al. | 252/174 |

FOREIGN PATENT DOCUMENTS

| | | | |
|---|---|---|---|
| 1069899 | 4/1986 | Japan . | |
| 1204123 | 9/1970 | United Kingdom | 252/94 |
| 2141965 | 1/1985 | United Kingdom . | |

*Primary Examiner*—Prince E. Willis

*Attorney, Agent, or Firm*—Bernard Lieberman; Murray M. Grill; Robert C. Sullivan

[57] ABSTRACT

A built synthetic organic detergent composition, in particulate or patty form, results from extruding such a composition, containing water in sufficient quantity to form at least some hydrate from hydratable builder salt, and with enough free water present to plasticize the composition without resulting in separation of liquid and solid phases, and converting the extrudate to particles or lightly compressing it to pre-measured form-retaining patties or cakes.

Also within the invention are processes for making such particulate and patty products, and methods of washing laundry with them.

11 Claims, 3 Drawing Sheets

BUILT SYNTHETIC ORGANIC DETERGENT COMPOSITION PATTIES AND PROCESSES FOR WASHING LAUNDRY THEREWITH

This invention relates to built synthetic organic detergent compositions. More particularly, it relates to such compositions in particulate and patty or cake forms, made from an extrudate. Such products possess significant advantages over comparable spray dried or granulated built particulate detergent compositions, and over detergent composition briquettes, tablets, and plodded and pressed built detergent composition bars, respectively.

Particulate built synthetic organic detergent compositions are well known and are the most popular form of household laundry detergent compositions now being marketed. Pressed built synthetic organic detergent composition tablets and briquettes have been marketed, as have been plodded and pressed built synthetic organic detergent composition bars. However, it is not believed that the products and processes of this invention were previously known, and such products are significantly better than such prior art products, and processes for production of the invented products are more advantageous than processes used to make such prior art products.

In accordance with the present invention a rod-shaped built synthetic organic detergent composition comprises multiple high moisture content cylinders of synthetic organic detergent, hydratable builder salt(s) for such detergent and water. In such extrudate the synthetic organic detergent will be present in an effective detersive proportion and the hydratable builder salt will be present in an effective building proportion. The water present acts to hydrate at least a portion of the hydratable builder salt(s), to give the extruded rods or particles a desired firmness and some free water is also present in the composition to act as a plasticizer to give the extrudate desirable coherence and cohesion. The extruded composition may contain various other components, especially conventional detergent composition adjuvants, such as perfumes, fluorescent brighteners, fabric softeners, bleaches, colorants, foaming agents, enzymes and soil release promoters.

In a preferred form of the invention, in which the extrudate is converted to relatively small particulate form, the rods are of equivalent diameter in the range of 0.5 to 3 mm. and of length in the range of 1 mm. to 1 cm., and the ratio of length to equivalent diameter is in the range of 1:1 to 20:1. In pre-measured patty or cake form, usually sufficient for charging to a washing machine for a single wash, the rod-shaped extrudate, normally of lengths, the weighted average of which is at least one cm., will be adhered together sufficiently to be form retaining while still being capable of being easily broken apart by the hands of the consumer.

In addition to the "particulate" and cake or patty product embodiments of the invention, also included therein are processes for the manufacture of the extrudate and of the end use products, and methods for washing laundry, using such products.

The built synthetic organic detergent compositions of this invention include synthetic organic detergent(s) hydratable builder salt(s) for such detergent(s), and water, and may contain conventional detergent composition adjuvants.

The synthetic organic detergent component is normally an anionic synthetic organic detergent, preferably of the water soluble sulfated and/or sulfonated lipophile type, but in some instances different synthetic organic detergents may be employed, usually as mixtures of anionic and nonionic detergents.

Of the synthetic anionic organic detergents those preferred are higher alkyl (preferably linear alkyl) benzene sulfonates, higher fatty alcohol sulfates, higher fatty alcohol ethoxylate or polyethoxylate sulfates, olefin sulfonates and paraffin sulfonates. Usually such compounds are water soluble alkali metal salts, such as sodium salts, and include higher fatty alkyl or other aliphatic moieties, which serve as lipophilic moieties, and which increase detergency. Such higher alkyl or higher aliphatic moieties will normally be of 8 to 20 carbon atoms, preferably 12 to 18 carbon atoms and more preferably, especially for the alkylbenzene sulfonates, 12 to 14 carbon atoms. As representatives of such detergents there may be mentioned sodium linear tridecylbenzene sulfonate, sodium linear dodecylbenzene sulfonate, sodium lauryl alcohol sulfate, sodium coco alcohol triethoxylate sulfate, sodium $C_{16}$ paraffin sulfonate and sodium olefin sulfonate derived from $C_{14}$ olefin.

Although nonionic detergents are not preferred detersive components of the present compositions and products, they may be employed, usually in relatively minor proportions, and normally in conjunction with anionic detergent(s). Among the nonionic detergents those which are most preferred are ethylene oxide condensates with higher fatty alcohols or with alkyl phenols, such as condensation products of 3 to 12 moles of ethylene oxide with higher fatty alcohols of 10 to 15 carbon atoms or with alkyl phenols of 7 to 10 carbon atoms in the alkyl groups, e.g., Neodol® 257.

In addition to the described anionic and nonionic detergents, in some instances amphoteric, ampholytic and zwitterionic detergents may be present, normally in relatively minor proportions, and in some instances cationic detergents may be utilized, also normally in relatively minor proportions, e.g., less than 10%, but in some circumstances, as when such cationic detergent or surface active agent is intended to be the fabric softener in a composition or product to be blended with or to be used with such detergent composition, so as in that way to produce a "softergent", up to 20 or 30% may be employed. Extensive listings of detergents that are useful for practicing the present invention may be found in standard textbooks relating to synthetic organic detergents, of which there may be mentioned herein, as representative, *Surface Active Agents* (*Their Chemistry and Technology*) by Schwartz and Perry, and the various annual editions of John W. McCutcheon's *Detergents and Emulsifiers*, e.g., that of 1980.

The hydratable builder salt(s) for the synthetic organic detergent(s) is preferably sodium tripolyphosphate but other such salts may also be employed, either alone or in mixture with such polyphosphate, such as tetrasodium pyrophosphate and other pyrophosphates, sodium carbonate, sodium sesquicarbonate, sodium silicate, sodium sesquisilicate and borax. In some instances it may be desirable to mix with such salts builders which are not hydratable, such as sodium bicarbonate. Hydratable filler salts may be employed in some instances but normally will desirably be omitted from the compositions because they add only bulk, not contributing to detergency. Of the builders the polyphosphates are highly preferred and of those sodium tripolyphosphate, in hydratable form, is most preferred. Of the silicates, which may be omitted from the formula when their binding and corrosion inhibiting functions are not needed, those preferred are of $Na_2O:SiO_2$ ratios in the range of 1:1.6 to 1:3, more preferably 1:2 to 1:2.6, e.g., 1:2.4. Although polyphosphate builders are highly preferable for their building and hydrating characteristics, in some instances the proportions of these materials (and of other phosphorus-containing compounds) will have to be limited, as to about 18% of sodium tripolyphosphate, in which cases any reductions therein will preferably be replaced by increases in the proportions of other builders, such as sodium carbonate and borax.

Water employed may be deionized water but tap water is also useful. Preferably, but not necessarily, the hardness of the water will be less than 300 p.p.m., as $CaCO_3$, and more preferably will be less than 200 p.p.m. Specific optional adjuvants include fluorescent brighteners of the stilbene type, isostearamide and/or quaternary ammonium halide fabric softeners (sometimes bentonite may be employed, too), sodium perborate bleach, Ultramarine Blue pigment, lauric myristic diethanolamide foaming agent, proteolytic and/or amylolytic enzymes, and polyethylene terephthalate—polyoxyethylene terephthalate copolymer soil release promoting agent.

The content of synthetic organic detergent, very preferably entirely synthetic organic anionic detergent, in the composition is in the range of 10 to 30%, preferably being 15 to 25%, and more preferably about 20%. The content of hydratable water soluble inorganic builder salt is in the range of 20 or 30 to 70%, preferably 40 to 60% and more preferably 50 to 55%. A preferred mixture of such builders includes 25 to 50% of sodium tripolyphosphate and 8 to 20% of sodium carbonate, with up to 8% of sodium silicate being optional. In a more preferred such mixture the proportions of such builder components will be in the ranges of 30 to 40% of sodium tripolyphosphate, 10 to 18% of sodium carbonate and 2 to 6%, e.g., about 4%, of sodium silicate. The ratio of weights of builder salt [total, on an anydrous basis) to synthetic organic detergent (preferably all anionic detergent) will normally be in the range of 1.5:1 to 5:1 and preferably is in the range of 2:1 to 4:1, e.g., about 2.6:1.

The proportion of water present in the invented products is normally in the range of 20 to 35%, preferably 20 to 30%, and more preferably about 25%. Because the compositions may lose from 0.5 to 3% or so of water during "curing" and any evaporative drying prior to packing (if in particulate form) or prior to forming into patties (when compacted), in making the extrudate, in rod-shape or spaghetti-like form, additional water will usually be incorporated in the composition formula to compensate for that lost by evaporation during the curing process. The ratio of weights of hydratable builder salt (total, on an anhydrous basis) to water will normally be in the range of 1:1 to 3:1, preferably being in the range of 1.5:1 to 2.5:1 and more preferably being about 2:1. Such water contents include hydrate water, too.

The total of adjuvants in the composition will normally be less than 10% and preferably will be in the range of 0.5 to 5%, often being in the range of 0.5 to 2%. In most cases contents of individual adjuvants will not exceed 5%, often being less than 2% and in many instances being less than 1%. However, if a filler, such as sodium sulfate, is present, the proportion thereof may be up to about 20% of the product weight (anhydrous basis) but preferably will be less than 5% thereof. More preferably, fillers will be absent from the composition. If, however, higher percentages of filler or other components are employed the ranges of proportions of other constituents may be diminished proportionately. For example, if 20% of sodium sulfate were to be present the proportion of hydratable builder salt (anhydrous basis) could be diminished, from a range of 30 to 70% to a range of 24 to 56%. In some instances, when good fabric softening is thought to be required, comparatively large proportions of fabric softening agent (3 to 10%, preferably 4 to 6% of di-higher alkyl dimethyl ammonium chloride or 15 to 40%, preferably 20 to 30% of bentonite) may be included in the compositions, and ranges of proportions of other components may be adjusted accordingly. However, to avoid such formula modifications in the case of the patties one may make separate patties that include sodium tripolyphosphate or other suitable hydratable salt(s) and fabric softener(s) and one or more of such may be packaged with the built detergent composition patties. Then a part of such softener patty may be used together with a detergent patty in the wash water to soften washed laundry. In such cases proportions of the fabric softening agents (or mixtures thereof) may be increased so that the part of the softener patty used will provide a sufficient proportion thereof in the wash water.

The rod-shaped built synthetic organic detergent composition extrudate resembles partly cooked spaghetti when the detergent composition is discharged from a suitable extruder through appropriately sized openings therein. Because the extruder employed operates at significantly lower temperatures and pressures than uncooled and straight-through soap and detergent composition extruders the extruded rods, cylinders or spaghetti pieces are uniform in composition and water therein does not separate from the other components. Such rods are desirably coherent and suitably adhesive so that they may be lightly compacted to cake or patty form, in which patties the individual rod-like pieces will still exist an be visible. Such structure, which is considered to be unique for detergent composition cakes, promotes more ready disintegration of the cake as it is added to the wash water, even when it is added to cold wash water, which is an important advantage of the present patties over previous detergent composition bars, tablets and briquettes.

The rod-shaped detergent composition of the invention, before being broken up or size-reduced to particulate form and before being made into cakes or patties, will be of an equivalent diameter in the range of 0.5 to 3 mm., preferably 1.5 to 2.5 mm. and more preferably about 2 mm. The lengths of the rods or spaghetti pieces exiting the extruder may be in the range of 1 to 50 cm. and the average (weighted average) of such lengths will be greater than 1 cm. Preferably, the lengths will be in the range of 5 to 25 cm., more preferably being in the range of 5 to 15 cm., with the weighted average of the lengths being at least 5 cm. and preferably at least 8 cm. The term "equivalent diameter" is employed to relate different cross-sectional rod shapes to cylindrical rods and to the diameter of a circle of corresponding cross-sectional area. Various shapes of rods may be employed, including square, rectangular, elliptical, V, B and X, but square and circular cross-sections are preferred. A square crosssection rod having an equivalent diameter of 2 mm. would have a side of about 1.8 mm.

If the rods exit the extruder of greater lengths than desired they may be automatically cut to the desired length by means of an automatic knife or other cutting or breaking device or they may be allowed to cure or dry sufficiently, as by overnight standing in buggies or in a bin, to become sufficiently "embrittled" to permit breakage by application of a "crushing" force or by shaking or other agitation. Such size reduction techniques and others may also be employed to reduce the rods to "particulate" form. The extent of the curing operation is usually based on empirical observations, rather than theoretical principles, but normally the detergent composition will lose from 0.1 to 1% of water content and from 0.5 to 5% of the free water present will be converted to hydrate form.

In particulate form the particles will still be of rod-like shapes, of equivalent diameters in the ranges previously given and of lengths in the range of 1 mm. to 1 cm., preferably 2 to 5 mm. and more preferably about 4 mm. The ratio of length to equivalent diameter will be in the range of 1:1 to 20:1 and preferably will be in the range of 3:1 to 5:1. For the rods which are to be lightly compacted to patty form equivalent diameters will be the same as previously discussed but the lengths will be greater, with the range of lengths being from 0.5 to 10 cm., preferably 1 to 5 cm., with the weighted average of such lengths being at least 0.8 cm. and preferably being at least 1 cm. or 2 cm.

The invention will be readily understood by reference to this specification and the description of the invention herein, taken in conjunction with the drawing, in which.

Figure 1:
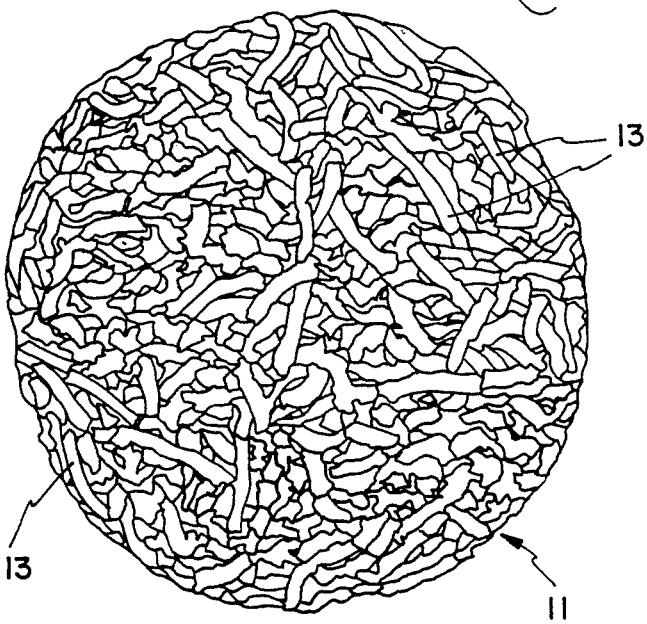
FIG. 1 is an enlarged photographic view of a major surface of a patty or cake of the present invention, showing the individual rod-shaped or spaghetti-like extrudate elements thereof.

In FIG. 1 numeral 11 designates a detergent composition patty of this invention, which is composed of lightly compacted rod-shaped or spaghetti-like extrudate portions 13, three of which are specifically designated.

Figure 2:
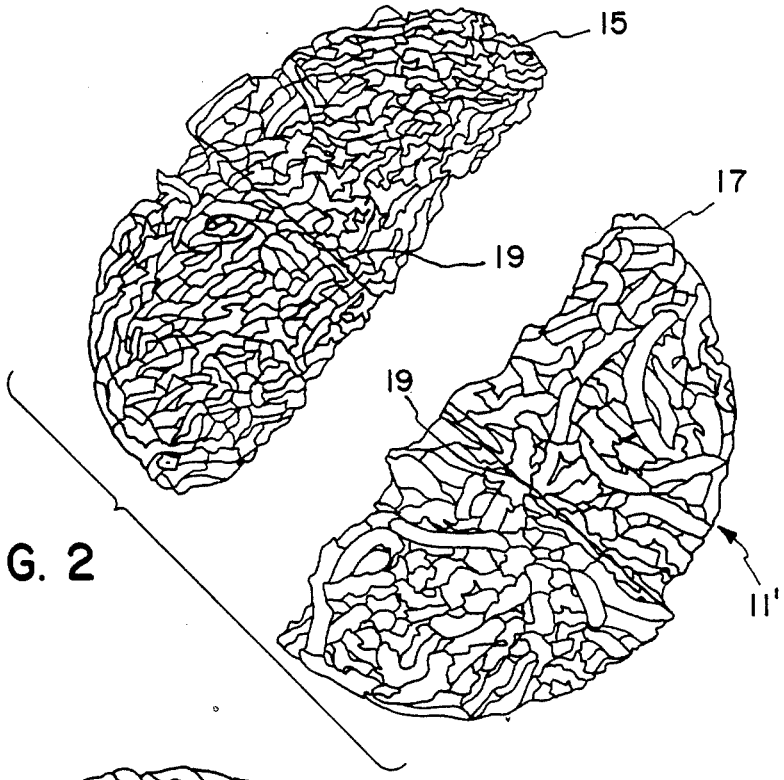
FIG. 2 is an enlarged photographic view of a patty like that shown in FIG. 1, separated into approximately equal parts.

In FIG. 2 a similar patty, 11', is shown, divided into halves 15 and 17, which division is readily effectable by bending forces applied to the bar by the hands of a consumer. As illustrated, the breaking apart of the bar occurred along an axis transverse to score line 19, but in practice breakage will usually be along such a score line, to promote even division, which facilitates utilizing a measured increased proportion of detergent composition during washing In FIG. 3, patty 11" is shown wrapped in transparent polymeric plastic (PVC) film 21, which is sealed together under a covering label Over the plastic film cover 21 for patty 11" is fastened paper label 23, under which the film covering is held together by being cemented to the label, which sometimes is preferably of a selfadhesive type or is heat sealable to the film covering. Label 23 has attached to it or as an integral part thereof a pull-tab 25, which is designed to open the covering 21 upon being pulled back, so that the contents of the package may easily be added to the wash water, after which the package is discarded. Of course, other quick opening devices may be used, In FIG. 4 there are schematically illustrated processes for manufacturing the particulate and patty products of this invention. Arrows 27, 29 and 31 represent the additions to mixer 33 of powdered hydratable builder salt(s), adjuvants, and aqueous detergent solution, respectively. In some instances, liquid materials will be withheld at this stage because of possible excessive lumping, in which cases they may be added directly to a kneader or extruder, or to intermediate apparatuses, prior to extrusion of the detergent composition. However, by proper control of the mixing operation, at least some of the liquid will often be addable to the mixer. The mix made is then passed to kneader 35 Sometimes kneading may be omitted but often it is desirable, to produce a uniform composition. Also, some hydration desirably takes place in the kneader (which may be in the nature of a dough mixer). After kneading, the kneaded composition passes to extruder 39, which is preferably of the type illustrated in FIG. 5. The composition is forced through peripheral openings in a circumferential screen and is thereby converted to rod-shaped solid extrudate. While other types of extruders can be employed, it is preferred to utilize one of the type illustrated, in which the extrusion pressure is comparatively low and the temperature of the mass being extruded is maintained at about room temperature or only slightly elevated above room temperature.

After extrusion the extrudate is conveyed to conditioning means 45, which may be a storage buggy or bin, in which it may be retained for a suitable period of time, such as one hour to one day, so as to allow partial drying and further hydration, if such had not already been "completed" previously. Subsequently, the extrudate is size reduced by a suitable "crushing" or shearing mechanism, such as a shaker, vibrating screen, mixer or rotating cutter. From size reducer 47 the product may be packaged for sale as particulate detergent composition, or sometimes (rarely) may be shaped, as in a shaper 49, which may be of the "Marumerizer" type, which is capable of making the particles into spheres, round ended cylinders, or into other suitable shapes. When the cake or patty type of product is desired, size reduction and shaping will ordinarily be omitted, and the conditioned extrudate may be sent directly to press 51, wherein it is lightly compacted to patty form, in which patty the individual rods of the extrudate are still present (which facilitates breaking up of the patty, when desired, and promotes dispersion thereof in the wash water). After pressing the extrudate to patty form it may be wrapped to produce a product like that illustrated in FIG. 3. Alternatively, it may be wrapped in aluminum foil or other suitable wrapping material, and in a further modification of the process the press may be self-cleaning, by having aluminum foil or polymeric plastic film between the press dies and the extrudate during pressing operations. Such foil or film may subsequently be sealed together by suitable means, or preferably, it may be heat sealed simultaneously with the pressing operation by circumferential heat sealing means, not illustrated.

Figure 5:
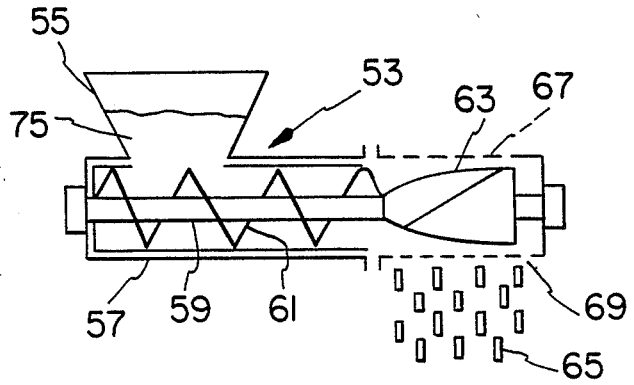
FIG. 5 is a schematic representation of an extruder that is employed to make the rod-like extrudates of built detergent composition of the present invention.

In FIG. 5 there is illustrated a preferred type of extruder, which is employed to convert a pasty mass from the kneader into rod-shaped extrudate or "spaghetti". Extruder 53 is comprised of an inlet section or hopper 55, a cylinder section or barrel 57, a shaft 59, a compression worm 61 and an enlarged discharge promoter or flared pusher 63. At the discharge end of the extruder barrel, discharge of the extrudate 65 is through screen 67 via openings 69 therein. Bearings 71 and 73 support the shaft, worm and discharger, and a power source, not illustrated, drives the shaft. In preferred embodiments of the extruder the shaft and the discharger are water cooled, and the barrel may also be cooled, to keep the temperature of the extruder contents low enough to avoid phase separation and to promote desirable hydration. Also, the speed of rotation and other extruder characteristics, such as clearances, worm pitch and, to an extent, peripheral screen openings, may be modified to regulate the pressure on the charge in the extruder. The charge 75 may be added to the extruder continuously from a kneader, mixer or other intermediate apparatus, or it may be manually charged to the extruder, as needed. An extruder that has been found to be suitable for the present operations is the Luwa Twin Screw EXD-100 Xtruder, made of No. 316 stainless steel. However, single screw extruders may also be employed, such as the EXB-7.5, and extruders produced by other manufacturers, such as soap plodders, equipped with suitable transverse discharge screens, rotating cutting knives and internal cooling systems.

To make the extrudate and the particulate and patty products is comparatively simple First, the various solid components are normally blended together in finely divided powder form, usually of particle sizes less than No. 100 and preferably less than No. 200, U.S. Sieve Series, in a powder mixer, such as a horizontal Day mixer or a V-shaped 2-shell blender. Subsequently any liquid components may be added in a suitable paste mixer or dough mixer (or kneader), or if the proportion to be added is sufficiently small, e.g., about 10% or less (some water already being present in the powdered material as water of hydration), the liquid may be added to the powder mixer. Also, in some cases, such as when the equipment is designed for easy transfers from the powder mixer to a kneader or extruder, the liquid (usually aqueous) may also be added to the powder mixer. After blending together of the various powdered components, with or without additional water or other liquid, the mix made is transported directly to an extruder or is first kneaded or mixed in a kneader or dough mixer type of apparatus so as to produce a completely wetted pasty mix. Such mix is then extruded into rod-shaped extrudate or spaghetti-like strands, with the extrusion taking place at a temperature which approximates room temperature, such as in the range of 10° to 30° C., preferably 15° to 25° C. The pressure in the extruder is kept reasonably low, such as in the range of 0.1 to 0.5 kg./sq. cm., gauge. Such extrusion pressure depends on worm speed, charge "viscosity" and screen opening size, and such factors may be regulated to maintain the pressure in the desired range. After discharge from the extruder the extrudate will contain substantially hydrated builder salt plus sufficient free water to plasticize the mix and give it coherent, yet flexible properties. Such proportion is normally in the range of 1 to 15%, preferably being 3 to 10%, e.g., about 4 to 7%. Of course, the plasticity of the extrudate may be adjusted by employing other plasticizers than water but preferably the composition will omit such materials that are not functional with respect to detergency, and reliance will be placed solely on water content for plasticizing effects.

If a particulate product is to be made such can be accomplished by breaking the extrudate to desired lengths and in some instances the shapes of the particles may be modified by a treatment such as "Marumerizing". After extrusion (usually followed by conditioning) the particles will be free flowing and may be boxed and treated in the same manner as other particulate detergents. If patties and cakes of detergent composition are to be made, normally being intended for use of a single patty per automatic washing machine load, the extrudate rods or spaghetti are conveyed to a suitable press, wherein they may be lightly compacted, as between a pair of opposed dies, which may fit in a suitable die-box. The product may be pre-weighed before charging to the press to ensure that each patty will be of desired weight. The pressing pressure will be low, normally being in the same general and preferred ranges as were previously mentioned for extrusion. If the product characteristics are such that such pressures result in patties that no longer exhibit individual rod-like component structures, showing that the rods have become fused together, that is an indication that they will be more difficult to break up, disperse and dissolve in the wash water than is desirable, and in such cases pressures may be lowered until the distinctive rod form shows in the products. However, the pressure will be high enough to be capable of impressing a score line across the patty, to facilitate division, as may be desired. To prevent undue sticking of detergent composition to the dies or die-box, suitable die lubricants, such as starch, talc, bentonite, magnesium stearate and other water insoluble soap powders may be employed. Instead of using the equipment described above it is considered that automatic or semi-automatic patty-making equipment, such as that employed to manufacture ground meat patties or hamburgers, may be utilized, sometimes after appropriate modifications.

Figure 3:
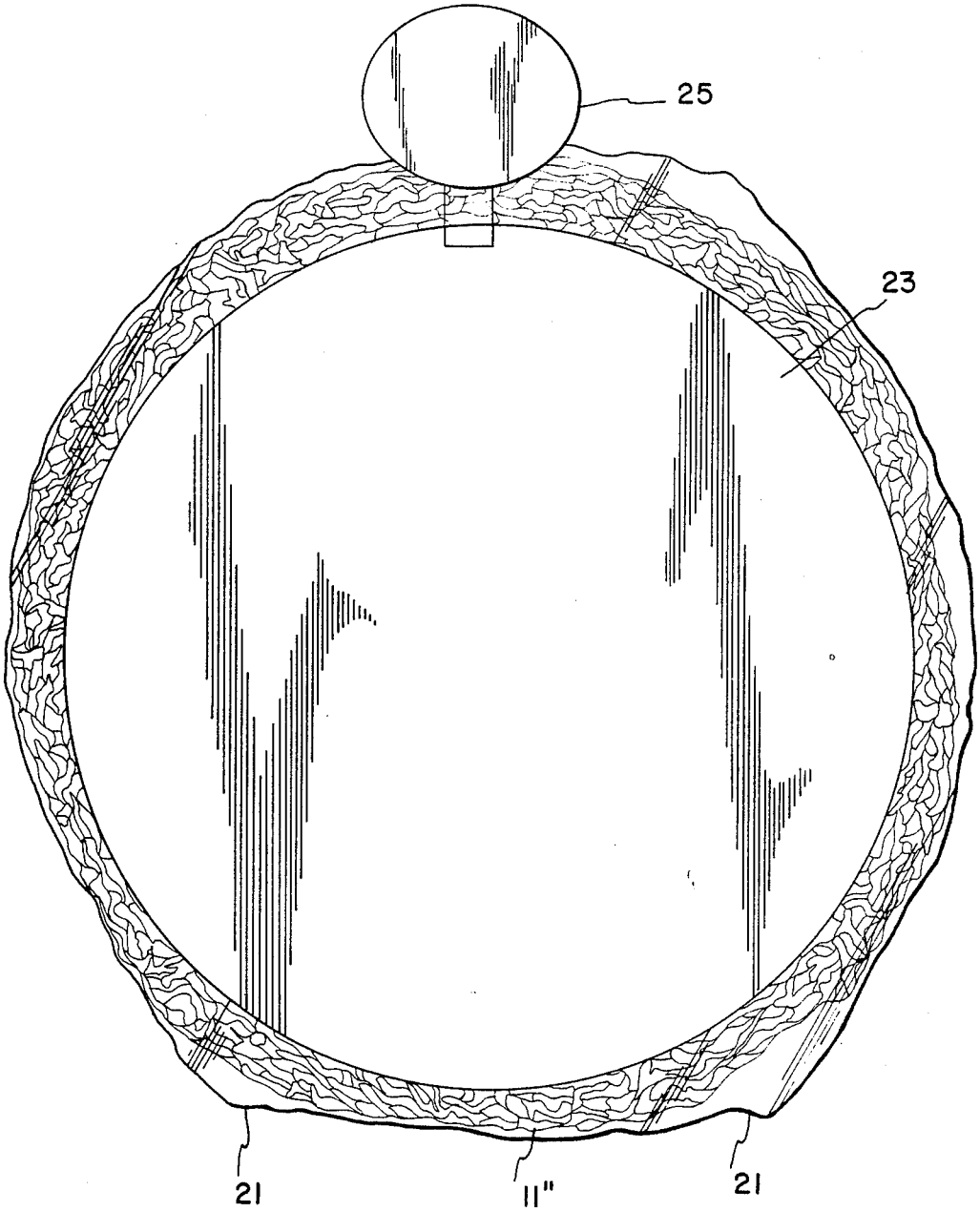
FIG. 3 is a further enlarged photographic view of a packaged patty of the type shown in FIG. 1.
Figure 4:
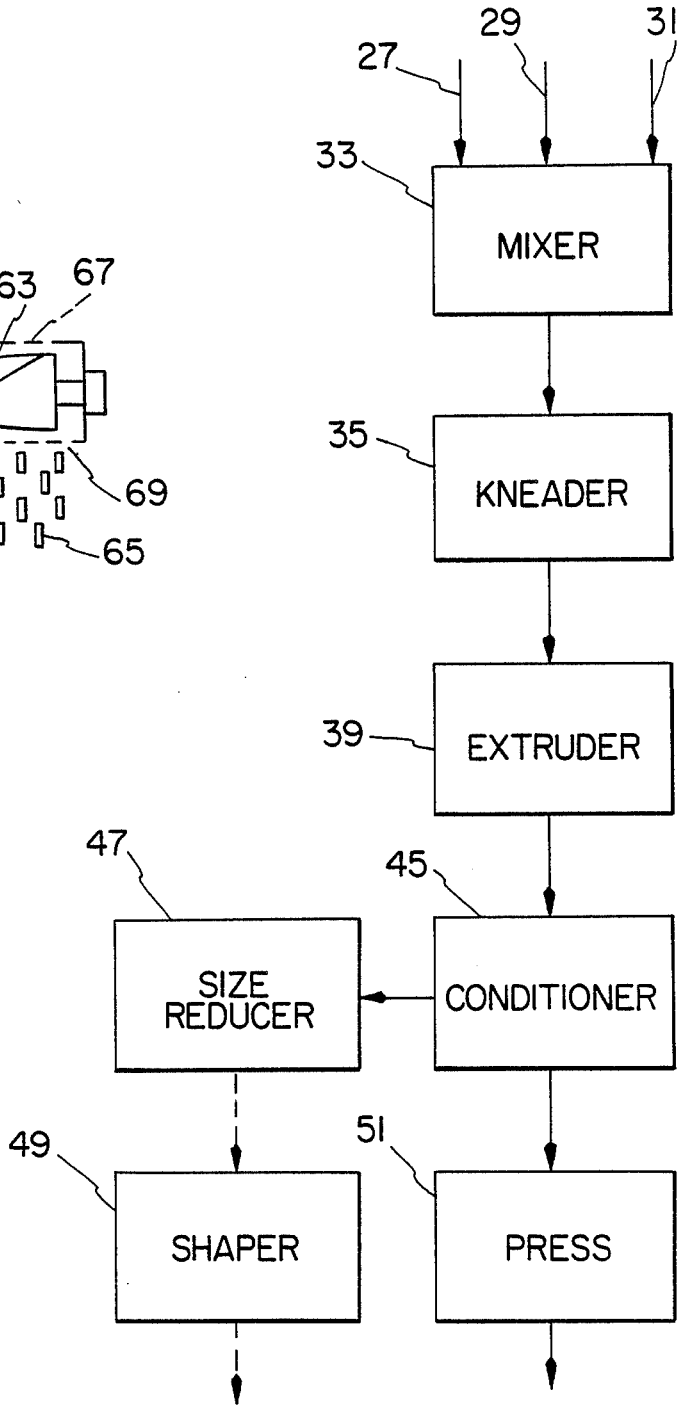
FIG. 4 is a flow diagram, illustrating manufacturing processes for making the particulate and patty products of the present invention.

After manufacture of the patties they may be wrapped and the wrapper may be sealed, preferably according to the process described in conjunction with the drawing (FIG. 3). Alternatively, although not necessarily preferably, the product may be wrapped in a water soluble film, such as a polyvinyl alcohol—polyvinyl acetate film, so that the product, wrapper and all, may be added to the wash water. Such procedure is not preferable because such products, when subjected to moisture, which is almost invariably present in the washing environment, tend to soften and break open, or they may allow evaporation of moisture from the patty, which could affect its "break-up", dispersing and dissolving properties. The wrapping of the patties may be carried out with semiautomatic or automatic wrapping equipment, like that used for individually or otherwise wrapping meat patties or textured vegetable protein patties, e.g., Gainesburgers®.

The physical characteristics and sizes of the particular products of this invention have already been described. The patties may be of any desirable shape but are preferably essentially flat cylinders in which the extrudate rods are of square or circular cross-section. Such flat cylinders will normally weigh in the range of 50 to 90 grams, preferably 60 to 80 grams, and will measure from 1 to 2 cm. in thickness, preferably 1.2 to 1.8 cm., and more preferably about 1.5 cm., and 5 to 9 cm. in diameter, preferably 6 to 8 cm. and more preferably about 7 cm. Thus, the bulk density of such product is about 0.8 g./c. cm. The bulk density of the particulate product will be about the same or slightly less, e.g., about 0.7 g./c. cm.

The patties, covered with water vapor impermeable or water vapor transmission resistant covering, such as polymeric plastic film or aluminum foil, may be further packed in vapor transmission resistant sleeves, which may then be boxed for retail sale. As was previously mentioned, to give the product fabric softening activity, fabric softening agents may be incorporated in the composition, such as mono- and di-$C_{12-18}$ alkyl trimethyl and dimethyl ammonium chlorides, bentonite and/or other fabric softener, and alternatively, patties may be made from hydratable builder salt and fabric softening agent, and such patties may be packed in the sleeves and boxes with the detergent composition patties, scored so as to be readily divisible for uses of desired portions thereof with the detergent composition patties in the wash water, as a fabric softening wash cycle additive.

Instead of packing the patties individually they may be packed unwrapped in a box or sleeve, with suitable separators, as of wax paper, between them.

One of the problems with detergent tablets and briquettes is that they often do not dissolve quickly enough in wash water, especially if it is tepid or cool. As a result, sometimes washed laundry, even after rinsing and automatic drying, exhibits deposits of undissolved detergent composition powder or particles. For that reason it is important that the present compositions contain enough moisture, which helps to promote breaking up, dispersion and dissolving of the components thereof, and it has been found that the invented particulate products and the patties, when broken up, if added to the wash water before the addition of the laundry, disperse and dissolve satisfactorily and do not leave undesired deposits on the laundry. However, to be prepared for "worst case scenarios", in which the consumer uses cold water, an extra large load of laundry, a relatively short washing cycle, relatively low agitation and only a single rinse, experimental work has been done to improve dispersion and solution rates further so that even under such circumstances no undissolved detergent composition components will be left on the laundry. One way in which this has been accomplished is by utilizing smaller extruder screen openings so that the extrudate is thinner. Similarly, the lengths of the particles and the lengths of the rods from which the patties are made may be decreased. It has also been found that incoporation of a relatively small proportion of bentonite and/or starch in the composition will speed break-up of the patty and thereby will promote dispersion and dissolution of its components. Such proportions of bentonite and/or starch may be in the range of 2 to 5%, to promote such break-up. The bentonite also exerts a fabric softening action and if desired, additional bentonite may be present for increased such fabric softening. Unexpectedly, it has also been found that a very small proportion of sodium polyacrylate, usually in the range of 0.2 to 2%, has a decided effect on promoting solubility of the product components in the wash water. Preferred proportions of sodium polyacrylate are in the range of 0.3 to 1% and more preferably 0.4 to 0.6% thereof is used. The polyacrylate employed is water soluble and is of a molecular weight in the range of 1,000 to 5,000, preferably 1,000 to 3,000 and more preferably of about 2,000. Such polyacrylate is available in powdered form from Alco Chemical Corporation, marketed under the trademark Alcosperse ® 107D. Testing has established that even under "worst case" conditions the presence of 0.5% of sodium polyacrylate in the present detergent compositions significantly improves their solubilities in wash water and significantly diminishes any deposition of undissolved composition components on washed laundry.

Various advantages of the present compositions have already been mentioned or are evident from the foregoing description. The particulate and patty embodiments of the invention can be made with relatively inexpensive, easy to operate and trouble-free equipment, which is not energy intensive. Also, due to the desirability of the composition being in paste form before extrusion there may be employed aqueous solutions of synthetic organic detergents and other components, which solutions would often not be compatible with other manufacturing processes. Many of the present compositions can be satisfactorily blended (and hydrated sufficiently) in the described Luwa Xtruder and so little or no kneading is required for them. Because spray drying has been obviated the invented particulate detergent compositions can be made and marketed in "third world" countries where spray drying towers are not available or where spray drying tower capacity is insufficient. Also, sodium linear higher alkylbenzene sulfonate and several other anionic detergents are normally supplied as aqueous solutions, which can be employed directly in the manufacture of the present extrudates, thereby saving the considerable expenses of purchasing dry detergents or of spray drying crutcher mixes of the aqueous detergent composition.

Product advantages of the invention are considered almost self-evident. The consumer can simply utilize the particulate product in the normal manner, or can easily break up the patty while it is still in its protective covering, and can charge the wash water with detergent composition without having to touch such composition. Neither product is dusty so neither is an irritant in air breathed by the user. The pre-measured nature of the patty removes the need to find a measuring cup and measure out the correct proportion of detergent composition, and spills are no problem. In summary, the invented products are easy to make, convenient to use and economical.

The following working examples illustrate but do not limit the invention. Unless otherwise indicated, all parts in these examples and in the specification and the appended claims are by weight and all temperatures in ° C.

EXAMPLE 1

EXAMPLE 1

| Component | Percent (by weight) |
|---|---|
| Sodium linear tridecylbenzene sulfonate | 20.0 |
| Sodium tripolyphosphate | 34.3 |
| Sodium silicate ($Na_2O:SiO_2$ = 1:2.4) | 4.3 |
| Soda ash | 14.3 |
| Fluorescent brightener | 0.4 |
| Perfume | 0.7 |
| Pigment (Ultramarine Blue) | 0.2 |
| Water | 25.8 |
| | 100.0 |

A particulate built synthetic organic detergent and a corresponding product in patty form are made of the above formula by first producing an extrudate in the manner described in the foregoing specification and subsequently reducing it to particulate form or converting it to patties.

The starting materials are either anhydrous or, if they contain water, as in the case of the silicate solution (which is 51.5% of water), such water content is indicated in the formula above as water and the content of such material indicated is on an anhydrous basis. Thus, 8.9% of a 48.5% solids aqueous silicate solution and 21.2% of added water are used.

First, a mixture of all the components is made in a suitable mixer of the horizontal shaft Day type. Optionally, the sodium silicate solution may be withheld at this stage and may be added subsequently, in the kneader or dough mixer after the water and other components and before the perfume. Dry mixing will normally take about 5 to 15 minutes, after addition of all the powders has been completed. Such powders are all of particle sizes substantially in the range of No's. 100 to 200, U.S. Sieve Series. The ambient temperature during mixing and the various other operations reported herein is in the range of 20° to 25° C.

After completion of such preliminary mixing the mixed charge is transferred to a kneader, dough mixer or Hobart mixer (all three of such types of apparatuses being useful interchangeably), after initial charging of the water to such apparatus. After the various powders have been blended into the water and together, any other aqueous materials and the aqueous sodium silicate solution are added (the silicate as a 48.5% aqueous solution), followed by perfume, and kneading is continued at a temperature in the range of 20° to 25° C. for approximately twenty minutes, during which time substantial hydration of the sodium tripolyphosphate takes place.

From the kneader the contents, in thick wet paste form, with about 5% free water present, are transferred to a twin screw, Type BXD-100 Luwa Xtruder TM and are extruded in separate runs, through a peripheral or circumferential screen having circular openings therein of about 1.5 mm. and 2 mm. diameter. An advantage of the formulations of these examples is that extensive kneading is often not required and components may be extruded after sufficient mixing in conventional mixers. In the extruder the extrusion temperature is kept from increasing substantially by internal apparatus cooling (in the worms or screws and in a jacket for the barrel of this "screw-in-barrel" extruder), so that the detergent composition mass remains at a temperature in the range of 15° or 20° to 25° C., e.g., about 22° C., which is also the temperature of the extrudate. The internal pressure of the extruder is kept low, at about 0.3 kg./sq. cm. gauge. The cylindrical or rod-shaped extrudate is allowed to fall into storage or curing buggies, in which it may be cured before further processing, if that is considered to be desirable, or from which it may be subsequently transferred to a storage bin. In handling the extrudate the spaghettilike material being discharged from the extruder tends to break into shorter lengths, such as those in the range of 1 to 5 cm., and of an average (weighted average) length of over 2 cm.

To make the patties of the present invention an appropriate shaping apparatus is employed. If labor costs are comparatively low, even hand shaping, with the assistance of appropriate forms, may be utilized, but normally it will be preferred to press the patties to shape in a suitable press, such as one comprised of a pair of opposed dies and a die-box into which such dies move to effect the compacting. Such an apparatus is used to make the patties of this example. The dies are coated with a suitable lubricant, either talc or magnesium stearate, in finely divided powder form, so that the resulting damp or wet patty is easily releasable from the dies and the box without leaving deposits on surfaces of press parts, and without breaking the patty. The pressing pressure is the same as the internal pressure in the extruder, about 0.3 kg./sq. cm. gauge. The patties resulting are of flat cylindrical shape, rounded at the edges thereof, and measure 1.5 cm. thick and 7 cm. in diameter. They weigh 70 grams and are considered to contain sufficient detergent composition for one wash in an average automatic washing machine.

After manufacture the patties are wrapped in either 0.05 mm. polyethylene or 0.05 mm. PVC transparent film, which film is sealed at the gathering thereof, over a major surface of the patty, by a glazed printed paper label, equipped with tear tab, like that shown in FIG. 3.

In an alternative packaging procedure sheets or sleeves of the polymeric foams are used to cover the charge of extrudate being shaped, which facilitates removal of the patty from the dies, and may be subsequently or simultaneously heat sealed about a portion or all of the periphery of the patty, with or without subsequent trimming away of any excess material. In place of the polymeric film, metal foil, such as aluminum foil, may be substituted, and for heat sealing operations it may be coated with a fusible polymeric plastic material at suitable locations. Also, in place of heat sealing of plastic film, shrink-wrap film may be employed, or vacuum sealing.

The patties made have impressed on them suitable score lines, such as that illustrated in FIG. 2, to facilitate division at time of use, if such is considered to be desirable. When so divided the interiors of the patties show that the extrudate rods or cylinders, which are in curved or bent form, due to being turned and bent back during the forming operation, have not fused together into a homogeneous mass but have retained their individual elongated structures. The lengths of the individual rod shaped pieces in the patty are in the range of 1 to 5 cm., for the most part, and the weighted average of such weights is more than 2 cm.

In the preceding description no mention was made of any curing or drying of the extrudate because frequently such is not necessary in order to obtain the desired product. In other words, sometimes the extrudate will include sufficiently hydrated hydratable builder salt(s) and sufficient free water, and will be of the desired total water content, so that curing to effect additional drying and hydration is not advantageous. However, often curing will be effected either intentionally or because the product made has to be stored before use, and in such instances, as when patties are made according to this example, the curing time is normally between 10 and 20 hours and moisture loss during that period is from 0.5 to 1%. (In the present example the formula of the charge to the mixers and extruder is modified to compensate for the loss of water during the drying and curing processes). The cure extrudate is then used to make the particulate detergent composition product of this invention.

To make the particulate detergent, after the described curing operation, the extrudate is broken, using a horizontal shaft mixer of the Day type, for example, so that the particles thereof resulting are substantially all in the 2 mm. to 1 cm. length range. In some instances, after such breakage, the particles are further dried, with an additional loss of 0.5 to 1% of water, so as to improve their flowability and prevent adherences to other particles, especially at the freshly cut or exposed surfaces. Then the particulate product is packaged and is ready for use.

EXAMPLE 2

The procedure of Example 1 is followed except that the synthetic anionic organic detergent is replaced by sodium linear dodecylbenzene sulfonate and it is charged to the kneader or dough mixer as a 40% aqueous detergent solution, being accompanied by 52% of water, 5% of isopropanol and 3% of sodium sulfate. Some of the isopropanol is lost during processing due to evaporation but some of it (about two-thirds) is found in the final products, with the sodium sulfate. The extra water (about 5%) increases the water content of the final products and decreases contents of other components proportionately.

The products made are essentially the same in properties as those of Example 1, with the particulate product being readily pourable from a dispensing container, and with the patty being relatively soft (being impressible with easy finger pressure) and easily crumbled to particulate form for use.

EXAMPLE 3

When the products of Examples 1 and 2 are employed to wash laundry, by being charged to 65 liters of wash water in a tub of an automatic washing machine and being employed to wash a mixed load of 3 kg. of soiled laundry, the laundry is washed clean and no objectionable deposits of undispersed and undissolved detergent composition material is found on it, after use of either the 1.5 or 2 mm. diameter extrudates, either particulate or in patty form. This is so when the washing temperature is 60° C. (hot water), 40° C. (warm water), and 20° (cold water). Of course, before use the patties are crumbled so the crumbled rods resemble the particulate detergent composition in sizes.

In variations of this experiment the concentrations of the detergent composition in the wash water are varied within the range of 0.05 to 0.3% and although washing is not as good at such lower concentrations, no residue is found on the washed laundry in any such cases.

In another variation of this experiment, the composition includes 0.5% of sodium polyacrylate (molecular weight of 2,000), and improved break-up of the patty parts in the wash water is noted, as are improved break-ups of detergent composition particles and individual rod portions from the patties in waters in the automatic washing machine during normal washing cycles.

EXAMPLE 4

Following the procedures described in Examples 1 and 2 fabric softening patties are made from an extrudate which comprises 20% of dimethyl distearyl ammonium chloride, 34.7% of sodium tripolyphosphate, 4% of sodium silicate, 14% of soda ash, 0.4% of fluorescent brightener, 0.7% of perfume, and 0.2% of red dye, with 26% water. Such patties are scored so that they may be readily divided into quarters, and to soften laundry one-quarter of such a patty is employed together with one of the detergent patties, per wash load. In a similar manner the pink and blue particulate products may be mixed in desired proportion (approximately 1:4 softening product:washing product) and such particles may be mixed together and sold as one product. Alternatively, as when it is desirable to keep one formulation separate from another, extrudates of both such types of products may be fed to the pressing dies in such manner as to result in different pressed sections of the finished patty containing the different components. Similar patties may contain other separated detergent compositions and softening composition, detergent composition and bleach composition, detergent composition and enzyme composition, and interacting effervescing components (as with a detergent composition containing sodium carbonate and/or sodium bicarbonate and an acidic composition containing citric acid with nonreactive carrier).

When it is desirable to keep components of products of this invention separate from each other this can be accomplished by having them in separate patties or in separate sections of the same patty, and by such means bleaching detergent products containing sodium perborate, and fabric softening detergent products containing quaternary ammonium salts and/or bentonite can be made. Similarly reactive components can be kept separate in particulate products. When interaction does not take place or is acceptable the "reactive" materials may be in the same extrudate, in different but mixed extrudates, or they may be suitably separated.

EXAMPLE 5

| Component | Parts (by weight) 5A | 5B | 5C | 5D | 5E |
|---|---|---|---|---|---|
| Sodium linear tridecylbenzene sulfonate (40% aqueous solution, containing 5% ethanol and 3% sodium sulfate) | 44.0 | 43.1 | 42.6 | 42.0 | 40.8 |
| Sodium tripolyphosphate | 37.5 | 36.5 | 35.9 | 35.1 | 34.4 |
| Blue dye | 0.04 | 0.04 | 0.04 | 0.04 | 0.04 |
| Water | 0 | 0 | 0 | 2.2 | 4.3 |
| Soda ash | 15.1 | 15.1 | 15 | 14.8 | 14.5 |
| Fluorescent brightener | 0.4 | 0.4 | 0.4 | 0.4 | 0.4 |
| Sodium polyacrylate (M.W. = 2,000) | 0.6 | 0.6 | 0.5 | 0.5 | 0.5 |
| Sodium silicate of $Na_2O:SiO_2$ = 1:2.4 (as 48.5% solids aqueous solution) | 0 | 4.5 | 9.2 | 9.1 | 8.8 |
| Perfume | 0.8 | 0.8 | 0.8 | 0.8 | 0.8 |

The five formulas are each made by mixing the described components together in a kneading apparatus of the dough mixer type. The order of addition is detergent solution, followed by water (if any), dye and sodium tripolyphosphate powder, which sub-mixtures are mixed for ten minutes before additions of the balances of the formulas, which additions are in the order given. After completion of all additions mixings are continued for another five minutes and then the mixed pasty masses are added, in separate runs, to a Luwa EXD-100 Xtruder, which has an output rate in the range of 100 to 300 kg./hr. The extruder operates to produce the desired rod-shaped extrudates, which are like those described in Examples 1 and 2. The extrudates are made into particulate products and into patties, which are packaged and tested according to the methods given in the previous working examples. The products resulting are very satisfactory built synthetic organic detergent products and wash laundry well without leaving objectionable deposits of undissolved detergent composition components on it. The patties made crumble readily in response to hand pressure and the particulate materials are sufficiently free flowing so as to be easily poured from a box, in the usual manner.

All the above formulas are readily processed in the dough mixer (or kneader) and in the extruder at low temperatures and low pressure, like those described in Examples 1 and 2.

EXAMPLE 6

A fabric softening synthetic organic detergent composition (softergent) is made of a formula like that of Example 1 except for replacement of 4.3% of sodium tripolyphosphate and 2.1% of soda ash with 6.4% of dimethyldistearyl ammonium chloride in that formula. The resulting formula, designated A, is of 20.0% of sodium linear tridecylbenzene sulfonate, 6.4% of dimethyl distearyl ammonium chloride, 30.0% of sodium tripolyphosphate, 4.3% of sodium silicate ($Na_2O$:$SiO_2$=1:2.4), 12.2% of soda ash, 0.4% of fluorescent brightener, 0.7% of perfume, 0.2% of Ultramarine Blue pigment and 25.8% of water. Because it is desirable to prevent any avoidable reaction of anionic detergent with cationic quaternary ammonium halide fabric softener, such compounds will normally be extruded to "spaghetti" form in different formulations and the different spaghetti types may then be shortened to rod forms and mixed together to make particulate softergent, or may be mixed, with or without such size reductions, and pressed to patties. The separate spaghetti types are made by the procedures described in Example 1 and the resulting mixed extrudates, in both particulate and patty forms, when tested, satisfactorily wash and soften laundry, without depositing greasy smears of fabric softening compound on such washed items.

In the preferred mixed softergent spaghetti or rods the "anionic" spaghetti or rods formula, designated as Formula B, includes 26.7% of sodium linear tridecylbenzene sulfonate, 29.8% of sodium tripolyphosphate, 4.3% of sodium silicate ($Na_2O_2$=1:2.4), 12.1% of soda ash, 0.4% of fluorescent brightener, 0.7% of perfume, 0.2% of Ultramarine Blue (pigment) and 25.8% of water. The cationic, fabric softening spaghetti and rods are designated as Formula C and are 25.6% of dimethyl distearyl ammonium chloride, 30.6% of sodium tripolyphosphate, 4.3% of sodium silicate (same 1:2.4$Na_2O$:$SiO_2$ ratio), 12.4% of soda ash, 0.4% of fluorescent brightener, 0.7% of perfume, 0.2% of Ultramarine Blue pigment and 25.8% of water. To produce a softergent product of the composition of Formula A there are blended together 1 part by weight of rods or spaghetti of Formula C with 3 parts by weight of rods or spaghetti of Formula B. The mixed rods or spaghetti may be converted to particulate or patty forms, as desired.

The proportions of Formula B and C portions may be in the range of 1:5 to 1:2 for the given formula and similar formulas but the formulas of the portions will be changed, if necessary, so as to keep the components within the given ranges. If desired, the spaghetti or rods (or particles) of the B and C formulas may be differently colored, which coloration can serve to identify the active components of the compositions. Thus, for example, the Formula B portion may be blue, pigmented with Ultramarine Blue, while the Formula C portion may be dyed pink, as by replacement of the blue pigment with an aqueous solution of red dye, e.g., Rhodamine B or an F.D.& C. red. In the patties the differently colored rods may be so located to produce a pattern or design, if desired.

In such products the content of quaternary ammonium halide fabric softener may be varied from 4 to 30%, and bentonite-type fabric softening compositions and perborate bleach detergent compositions may also be manufactured, in particulate and patty forms, usually of bentonite contents in the range of 10 to 30%, preferably 17 to 22%, e.g., about 20%, and of sodium perborate monohydrate (anhydrous basis) contents of 10 to 30%, preferably 10 to 20%, e.g., about 14%. For example when 20% of bentonite is present the formula of Example 1 may be changed by decreasing the sodium tripolyphosphate (STPP) content to 20.2% and decreasing the soda ash content to 8.4% to make up for the 20% of bentonite included. Similarly, to compensate for the inclusion of 14% of sodium perborate monohydrate the Example 1 formula amounts of STPP and soda ash may be reduced to 24.4% and 10.2%, respectively. Alternatively, the fabric softener(s) or bleach in particulate form, may be mixed with the spaghetti or rods of a formula like Formula A to make particulate or patty products.

When used to wash soiled laundry in an automatic washing machine at concentrations of about 0.1% and about 0.15% the described compositions satisfactorily wash and soften (for those containing quaternary ammonium salt or bentonite), and wash and bleach (for those containing sodium perborate bleach), respectively.

EXAMPLE 7

In variations of the above examples, other anionic detergents are employed in place of the sodium linear alkylbenzene sulfonates, such as sodium lauryl alcohol sulfate and sodium myristyl triethoxylate sulfate, tetrasodium pyrophosphate is employed in replacement of one-third of the sodium tripolyphosphate, borax replaces half of the sodium carbonate, and enzymes and polyethylene terephthalate—polyoxyethylene terephthalate copolymer soil release promoting agent are incorporated in the detergent composition as adjuvants (2% of each) Also, in such and other compositions the proportions in the foregoing examples are varied ±10%, ±20% and ±25%, keeping within the ranges given in the specification. Such products are satisfactorily processed, are of desirable washing characteristics and possess other properties required of commercially acceptable particulate and "single charge" detergent products.

Similarly, when the processing conditions are varied within the ranges previously described in the specification processing proceeds smoothly and the desired extrudates and particulate and patty products result. Such products meet with desirable consumer responses, and favorable consumer evaluations with respect to form and convenience of use are especially high.

This invention has been described with respect to various embodiments and illustrations but it is not to be limited to these because it is evident that one of skill in the art, with the present specification before him, will be able to utilize substitutes and equivalents without departing from the invention.

What is claimed is:

1. A pre-measured form-retaining built synthetic organic detergent composition patty or cake comprised of multiple rod-shaped extrudates of synthetic organic detergent, hydratable builder salt(s) for such detergent, and water, wherein the rod-shaped extrudates are of equivalent diameter in the range of 0.5 to 3 mm. and of a length in the range of 0.5 to 10 cm., with the ratio of length to equivalent diameter being in the range of 1:1 to 20:1, with the rods thereof being adhered together sufficiently to be form-retaining while being capable of being easily broken apart by the hands of a consumer, which patty consists of a pre-measured charge of detergent composition for addition to the wash tub of an automatic washing machine.

2. A patty according to claim 1 which comprises 10 to 30% of synthetic organic detergent, 30 to 70% (anhydrous basis) of hydratable water soluble inorganic builder salt, 10 to 30% (anhydrous basis) of sodium perborate and 20 to 35% of water, with the ratio of weights (anhydrous bases) of such hydratable builder salts to synthetic organic detergent being in the range of 1:5 to 5:1, and with the ratio of weights (anhydrous bases) of such builder salts to water being in the range of 1:1 to 3:1.

3. A patty according to claim 1 which comprises 10 to 30% of synthetic organic detergent, 30 to 70% (anhydrous basis) of hydratable water soluble inorganic builder salt, 4 to 30% of quaternary ammonium halide and 20 and 35% of water, with the ratio of weights (anhydrous bases) of such hydratable builder salts to synthetic organic detergent being in the range of 1.5:1 to 5:1, and with the ratio of weights (anhydrous bases) of such builder salts to water being in the range of 1:1 to 3:1.

4. A patty according to claim 3 wherein the quaternary ammonium halide is in extrudates which contain no synthetic organic anionic detergent.

5. A detergent composition patty according to claim 1, comprising, by weight, 10 to 30% of synthetic organic anionic detergent, 30 to 70% (anhydrous basis) of hydratable water soluble inorganic builder salt and 20 to 35% of water, with the ratio of weights of such builder salt (anhydrous basis) to synthetic organic anionic detergent being in the range of 1.5:1 to 5:1 and the ratio of such weights of builder (anhydrous basis) to water being in the range of 1:1 to 3:1, which patty is formed of adhering rods of such composition of equivalent diameter in the range of 0.5 to 3 mm. and of lengths of a weighted average of at least 1 cm.

6. A detergent composition patty according to claim 5 which comprises from 0.2 to 2% of sodium polyacrylate to assist in promoting complete break-up and solution of the detergent composition components in the wash water, and in which the rods are in bent or curved forms and are individually discernible at surfaces of the patty, so that surface areas thereof are thereby increased, compared to those of a solid or fused tablet, and break-up and dissolution in the wash water are promoted.

7. A detergent composition patty according to claim 6, which is plastic enough to be impressible by finger pressure, due to a plasticizing effect of free (nonhydrate) water present therein, the presence of which water helps to promote rapid dissolution of the composition in wash water, which patty is scored to assist in breaking it up for use and/or to measure out a part charge of detergent composition, and which patty is covered by a water vapor transmission resistant film or foil covering which is readily removable therefrom and which serves to protect the patty and prevent loss of water therefrom prior to use.

8. A patty according to claim 1 which is scored to assist in breaking it up for use and/or for measuring out a part charge of detergent composition.

9. A patty according to claim 1 which is covered by a water vapor transmission resistant film or foil covering which is readily removable therefrom and which serves to protect the patty and prevent loss of water therefrom.

10. A process for washing laundry which comprises adding a pre-measured built synthetic organic detergent composition patty according to claim 1 to wash water to that a detersive washing solution is made, and washing laundry in such solution.

11. A process according to claim 10 wherein the detergent composition of the patty comprises 15 to 25% of sodium linear higher alkylbenzene sulfonate wherein the higher alkyl is of 12 to 14 carbon atoms, 25 to 50% of sodium tripolyphosphate, 8 to 20% of sodium carbonate, 0 to 8% of sodium silicate and 20 to 35% of water, and the rods are of 0.5 to 3 mm. in equivalent diameter and of lengths of a weighted average of at least 1 cm., and are lightly compacted to a patty weighing in the range of 50 to 90 grams, the concentration of the built detergent composition from such patty in the wash water is in the range of 0.05 to 0.3% by weight, and washing of the laundry is effected in a washing machine.

* * * * *